US007661975B2

(12) United States Patent
Ma

(10) Patent No.: US 7,661,975 B2
(45) Date of Patent: Feb. 16, 2010

(54) ELECTRICAL SOCKET CONNECTOR WITH METAL REINFORCED DEVICE BETWEEN COVER AND BASE

(75) Inventor: Hao-Yun Ma, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,880

(22) Filed: Aug. 22, 2007

(65) Prior Publication Data

US 2008/0050945 A1 Feb. 28, 2008

(30) Foreign Application Priority Data

Aug. 22, 2006 (CN) ..... 2006 2 0075643

(51) Int. Cl.
*H01R 13/625* (2006.01)

(52) U.S. Cl. ..... 439/342

(58) Field of Classification Search ..... 439/342, 439/259, 264

See application file for complete search history.

(56) References Cited

U.S. PATENT DOCUMENTS

| | | | | |
|---|---|---|---|---|
| 4,504,105 | A * | 3/1985 | Barkus et al. | 439/331 |
| 5,482,471 | A * | 1/1996 | Mori et al. | 439/263 |
| 6,243,267 | B1 * | 6/2001 | Chuang | 361/704 |
| 6,254,415 | B1 * | 7/2001 | Mizumura et al. | 439/342 |
| 6,280,224 | B1 * | 8/2001 | Huang | 439/342 |
| 6,450,824 | B1 * | 9/2002 | Lemke et al. | 439/342 |
| 6,533,597 | B1 * | 3/2003 | Wang et al. | 439/342 |
| 6,616,471 | B2 * | 9/2003 | Renfro et al. | 439/342 |
| 6,619,974 | B1 * | 9/2003 | Hou et al. | 439/342 |
| 6,638,094 | B1 * | 10/2003 | Zhang et al. | 439/342 |
| 6,692,281 | B1 * | 2/2004 | McClinton et al. | 439/342 |
| 6,877,990 | B2 * | 4/2005 | Liao et al. | 439/41 |
| 6,910,908 | B2 * | 6/2005 | Tran et al. | 439/342 |
| 7,021,954 | B2 * | 4/2006 | Gattuso et al. | 439/342 |
| 7,182,620 | B1 * | 2/2007 | Ju | 439/331 |
| 7,195,508 | B1 * | 3/2007 | Ju | 439/342 |
| 7,322,844 | B1 * | 1/2008 | Hougham et al. | 439/342 |
| 7,335,030 | B2 * | 2/2008 | Kunioka et al. | 439/73 |
| 7,338,295 | B2 * | 3/2008 | Wooden | 439/73 |
| 7,361,029 | B2 * | 4/2008 | Hashimoto | 439/71 |
| 2003/0176096 | A1 * | 9/2003 | Tsai | 439/342 |
| 2003/0199189 | A1 * | 10/2003 | Chang | 439/342 |
| 2004/0058579 | A1 * | 3/2004 | Peng et al. | 439/342 |
| 2004/0077204 | A1 * | 4/2004 | Zeng | 439/342 |

(Continued)

*Primary Examiner*—T C Patel
*Assistant Examiner*—Vladimir Imas
(74) *Attorney, Agent, or Firm*—Andrew C. Cheng; Wei Te Chung; Ming Chieh Chang

(57) ABSTRACT

An electrical connector socket, comprising an insulating base defining a sector and a surrounding portion surrounding the electric area, a cover slidably mounted on the base, a metal reinforced device with a rectangular frame sandwiched between the base and the cover, and an actuation mechanism is also pivotally sandwiched between the base and the cover. The sector divided into several sections that each has at least one set of edge to form at least one channel thereon, and the metal reinforced device defines a bridge portion corresponding to the channel of the base. When the rotation of actuation mechanism, the metal reinforced device sustain greater forces exert on the base and the cover, the base and cover are resistant to deformation and maintain the effective displacement of the cover respect to the base.

13 Claims, 7 Drawing Sheets

U.S. PATENT DOCUMENTS

2004/0087199 A1* 5/2004 Tran et al. ..... 439/342
2004/0242047 A1* 12/2004 Nguyen ..... 439/342
2005/0014401 A1* 1/2005 Ma et al. ..... 439/135
2005/0020118 A1* 1/2005 Norris et al. ..... 439/342
2005/0130478 A1* 6/2005 Ma ..... 439/342
2005/0215102 A1* 9/2005 Yu et al. ..... 439/342
2005/0260879 A1* 11/2005 Nakao et al. ..... 439/342
2006/0003614 A1* 1/2006 Ma ..... 439/135
2006/0205259 A1* 9/2006 Hashimoto ..... 439/342
2008/0064230 A1* 3/2008 Zhang ..... 439/65

* cited by examiner

ELECTRICAL SOCKET CONNECTOR WITH METAL REINFORCED DEVICE BETWEEN COVER AND BASE

BACKGROUND OF THE INVENTION

1. Field of the Invention

The present invention relates to an electrical socket connector, and more particularly to a socket for electrically interconnecting an electronic package such as a central processing unit (CPU) with a circuit substrate, i.e. a printed circuit board (PCB).

The present invention relates to a socket, and more particularly to a socket configured with a base with a cover moveably assembled to the base, and the cover features a reinforced metal stiffener preventing the effective displacement of the cover with respect to the base be compromised by the deformation of the cover.

2. Description of the Prior Art

An electrical connector socket is widely used in personal computer (PC) systems to electrically connect CPUs with PCBs. A conventional socket, such as disclosed by U.S. Pat. No. 6,280,223 and U.S. Pat. No. 6,533,597 so-and-so, includes a base with a plurality of contact terminals assembled therein. A cover is moveably assembled on top of the base, and provided with an array of through holes aligned with the contact terminals assembled within the base. An actuating mechanism is arranged between the base and cover so as to drive the cover to move to and from with respect to the base. The actuating mechanism includes a cam arranged in the base, and a lever connected to the cam and extends outside of the base. When the lever is rotated, the cam is rotated to drive the cover to move from one direction, and when the lever moves back to its original position, then the cover is moved back to its original position as well.

During the rotation of the actuation mechanism, the actuation mechanism exerts force on the base and the cover. The base and the cover are liable to deform and reduce the effective displacement of the cover respect to the base, during enhance the forces acting thereon. When deformation occurs and the effective displacement changes effective displacement, the cover may not engage on the base. The holes of cover may not accurately coincide with the passageways of the base. This can impair mechanical and electrical engagement of the pins of the CPU with the contacts of the base. As a result, the reliability of electrical transmission through the electrical connector socket may be adversely affected. It can even result in failure of electrical connection between the CPU and the electrical connector.

Therefore, an improved electrical connector socket that overcomes the above-mentioned disadvantages is desired.

SUMMARY OF THE INVENTION

Accordingly, an object of the present invention is to provide an electrical connector socket for electrically connecting an electronic package such as a central processing unit (CPU) with a circuit substrate such as a printed circuit board (PCB), wherein the electrical connector socket has a metal reinforced device that resists the deformation and maintain the effective displacement of the cover respect to the base.

To achieve the above-mentioned object, an electrical connector socket in accordance with a preferred embodiment of the present invention comprises an insulating base including a plurality of passageways arranged in sectors across a top surface of the base and spaced from one another, each passageway assembled with a contact terminal; a metal reinforced device disposed on the base in an area between the sectors; a cover mounted on the base; and an actuation mechanism is arranged between the base and the cover so as to move the cover along the base.

When the rotation of the actuation mechanism, the metal reinforced device sustain greater forces exert on the base and the cover, the base and cover are enough hard to withstand forces from the actuation mechanism.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Figure 1:
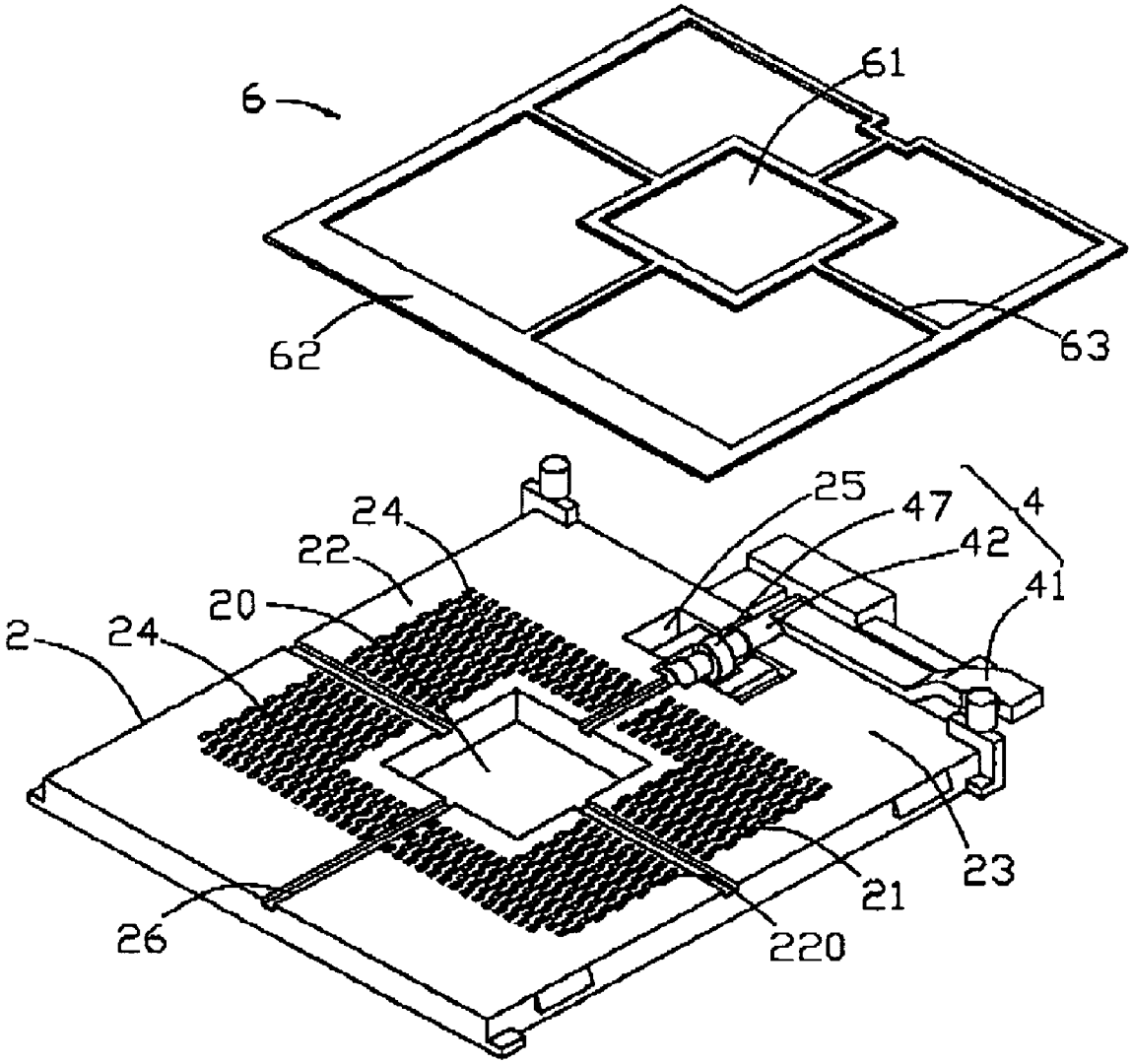
FIG. 1 is an exploded, isometric view of an electrical connector socket in accordance with the preferred embodiment of the present invention.

Reference will now be made to the drawings to describe the present invention in detail.

Referring to FIGS. 1-5, an electrical connector socket (not shown) in accordance with a preferred embodiment of the present invention is for electrically connecting a central processing unit (CPU) (not shown) to a printed circuit board (PCB) (not shown). The connector comprises an insulating base, a cover slidably mounted on the base, an actuation mechanism is pivotally sandwiched between the base and the cover, and a metal reinforced device sandwiched between the base and the cover too.

The actuation mechanism 4 in accordance with the present invention is arranged between the base 2 and the cover 3. According to the preferred embodiment, the actuation mechanism 4 comprises a driving shaft 42 with a transferring helical sector 47 and a lever arm 41 being linked perpendicular to an end of the driving shaft 42.

The electrical connector socket further defines a follower 5 having a slot 52 capable of partially receive the helical sector 47 of actuation mechanism 4.

Figure 2:
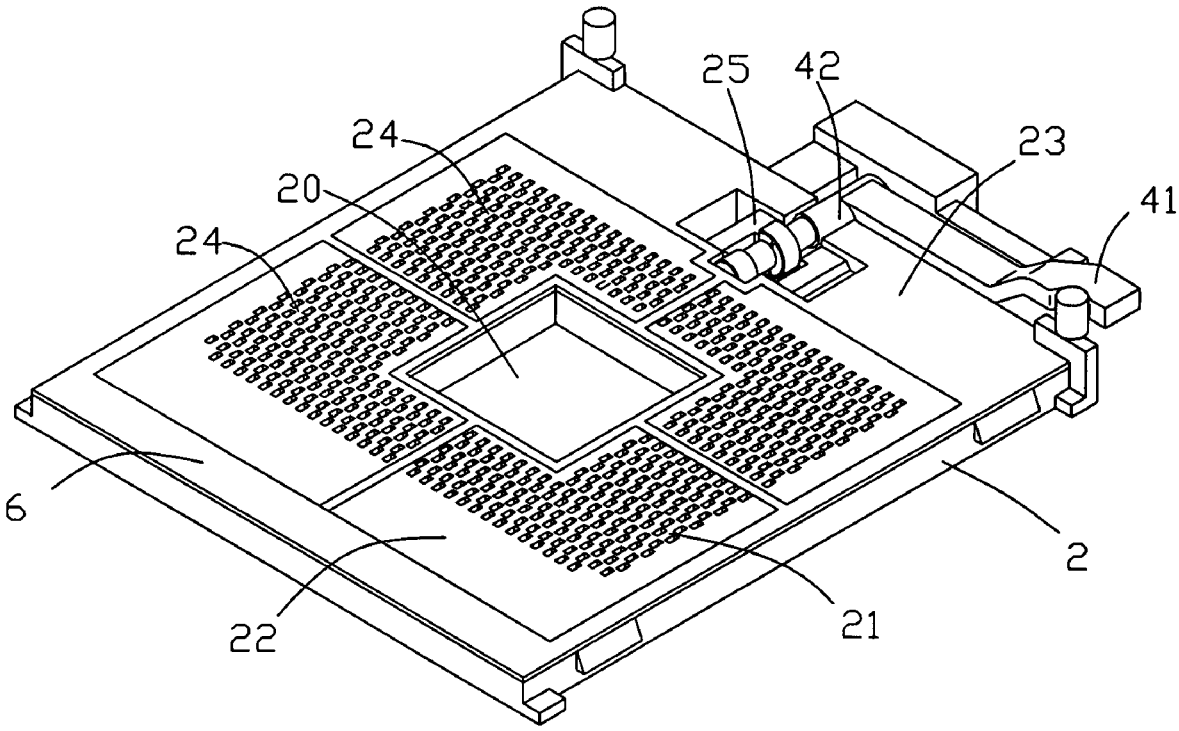
FIG. 2 is an assembled view of FIG. 1 removed the cover.

Referring to FIGS. 1-2, the insulating base 2 is substantially rectangular and comprises a plurality of passageways 220 arranged in sector 21 across a top surface of the base (not labeled) and spaced from one another, each passageway 220 assembled with a contact terminal (not shown), a surrounding portion 22 surrounded the sector 21 thereof and a top portion 23 extending from the sector and surrounding portion 22, respectively. The top portion 23 is provided with a shaft seat 25 in which the driving shaft 4 can be rotationally seated therein. The base 2 further defines a rectangular opening 20 in a center thereof. In a typical embodiment, the sector 21 is divided into four sections 24 that each has two (inner) edges to form some channels 26. However, it should be understood that the teachings of the present invention could be implemented with any quantity of sections. For example, the teachings of present invention could be utilized to form a connector from two sections that each includes one set of edges.

The cover 3 comprises a main plate 31, a peripheral portion 32 surrounding the main plate 31, a head portion 33 extending from one side of the main plate 31 for positioning the follower 5, and two side plates 34 depending from another opposite sides of main plate 31 respectively. A multiplicity of through holes 310 is correspondent to the passageways 220 of the base 2 are defined in the main plate 31. The head portion 33 defines a secure cavity 35 for receiving the follower 5. The cover 3 further defines a rectangular slit 30 in a center thereof corresponding to the rectangular opening 20 of the base 2.

The metal reinforced device 6 is covered onto the base 2 with a substantially rectangular configuration. The metal reinforced device 6 stamped and formed from a sheet of metallic material comprises a groove 61 corresponding to the opening 20 of the base 2 in a center thereof, a rectangular frame 62 covered the surrounding portion 22 of the base 2, and a bridge portion 63 connecting to the groove 61 and the rectangular frame 62. The shape of bridge 63 is correspondent to the channels 26 of base 2.

Figure 3:
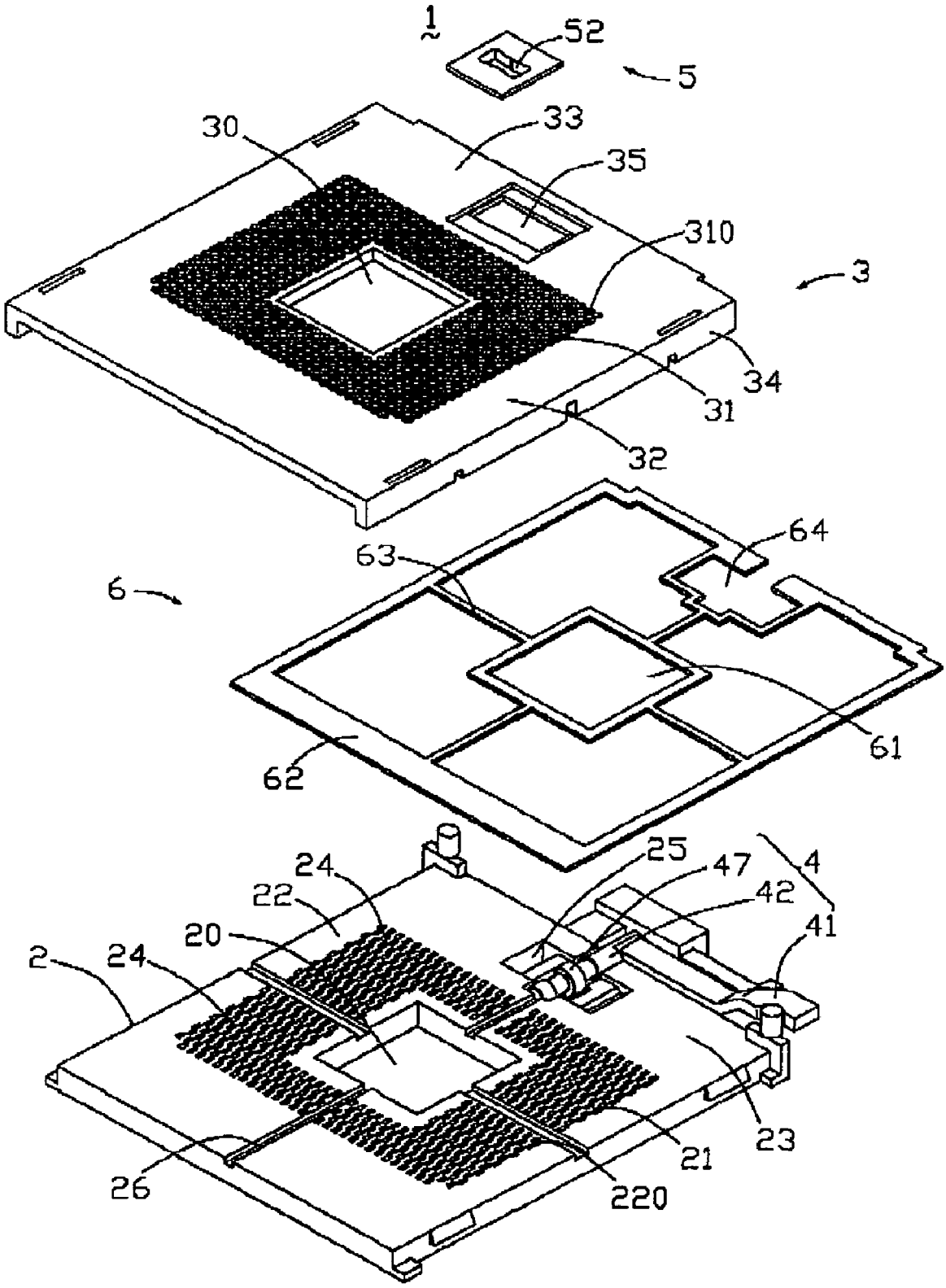
FIG. 3 is an exploded, isometric view of an electrical connector socket in accordance with a second embodiment of the present invention.
Figure 4:
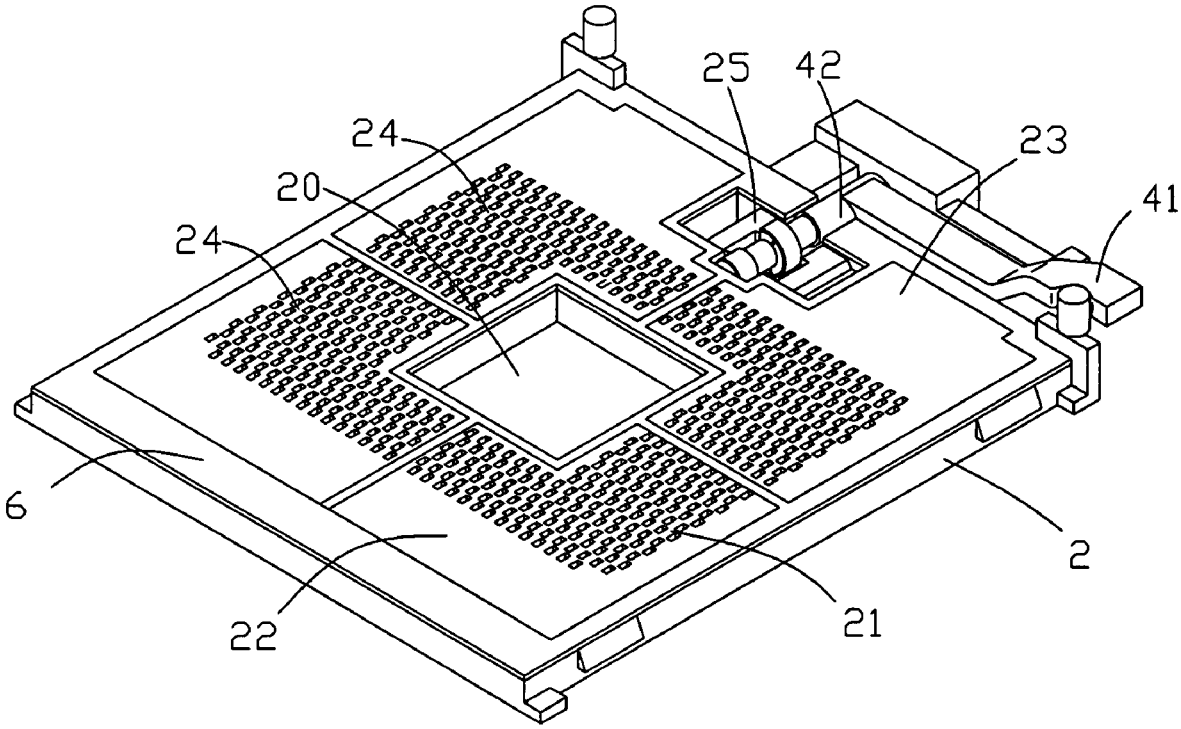
FIG. 4 is an assembled view of FIG. 3 removed the cover.

Referring to FIGS. 3-4, the metal reinforced device 6 of the second embodiment of the present invention is shown. The cover 3 and the base 2 are similar to the first embodiment and the frame 62 of metal reinforced device 6 is covered the surrounding portion 22 and the top portion 23 of the base 2 respectively. The metal reinforced device 6 further defines a window 64 for positioning the shaft seat 25 of base 2 when the metal reinforced device 6 is covered onto the base 2.

Figure 5:
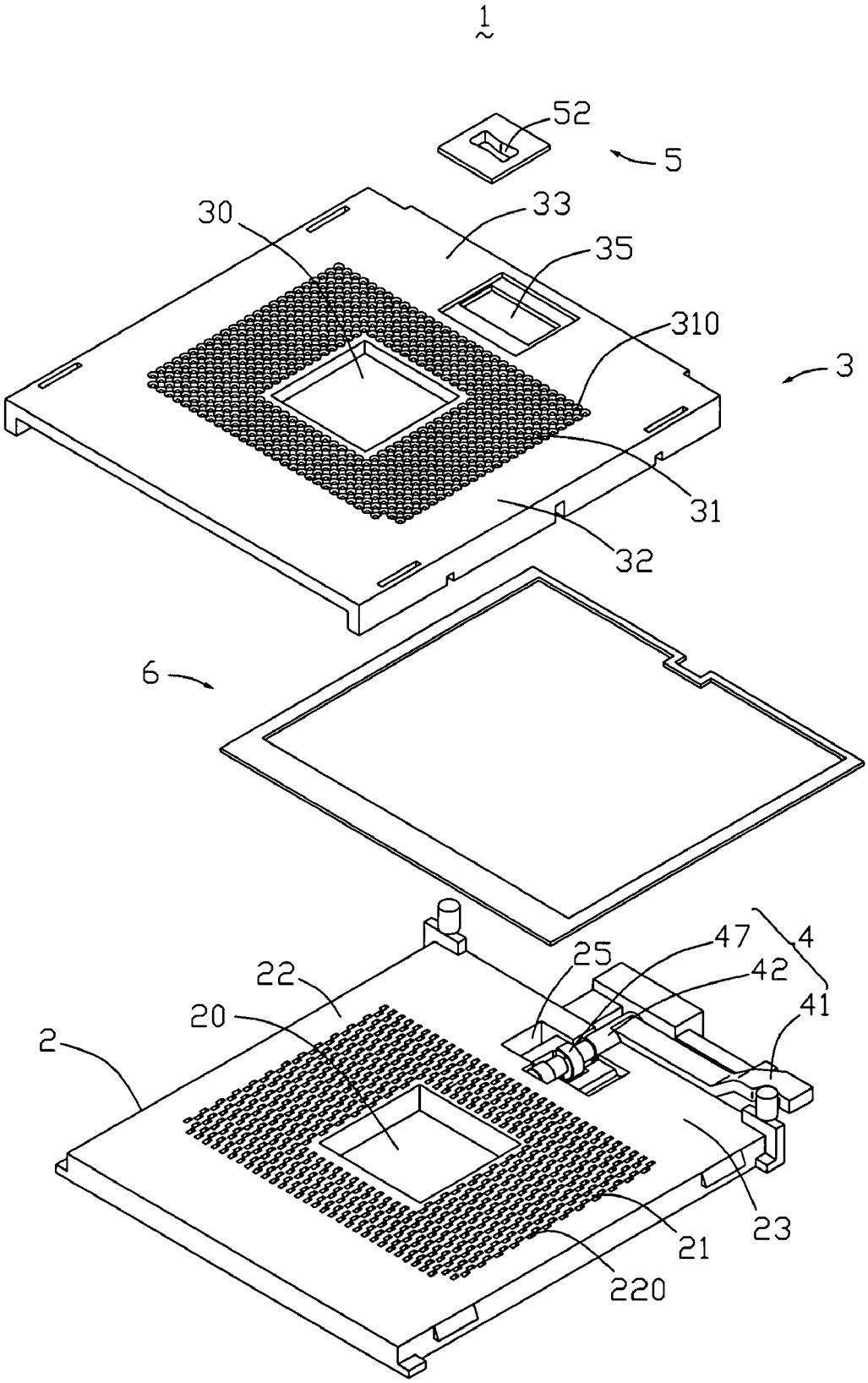
FIG. 5 is an exploded, isometric view of an electrical connector socket in accordance with a third embodiment of the present invention.
Figure 6:
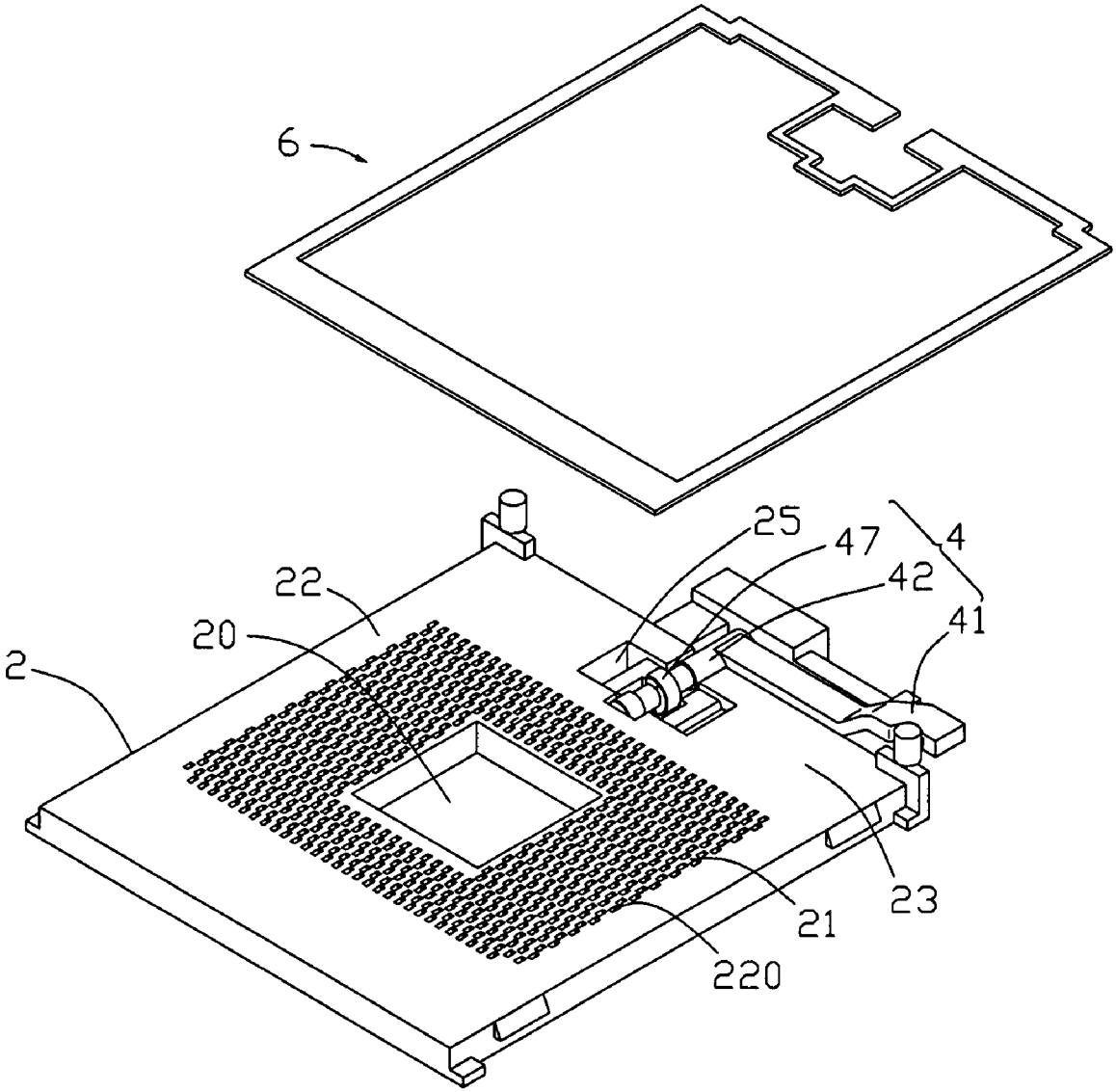
FIG. 6 is an exploded, isometric view of an electrical connector socket in accordance with a four embodiment of the present invention removed the cover.
Figure 7:
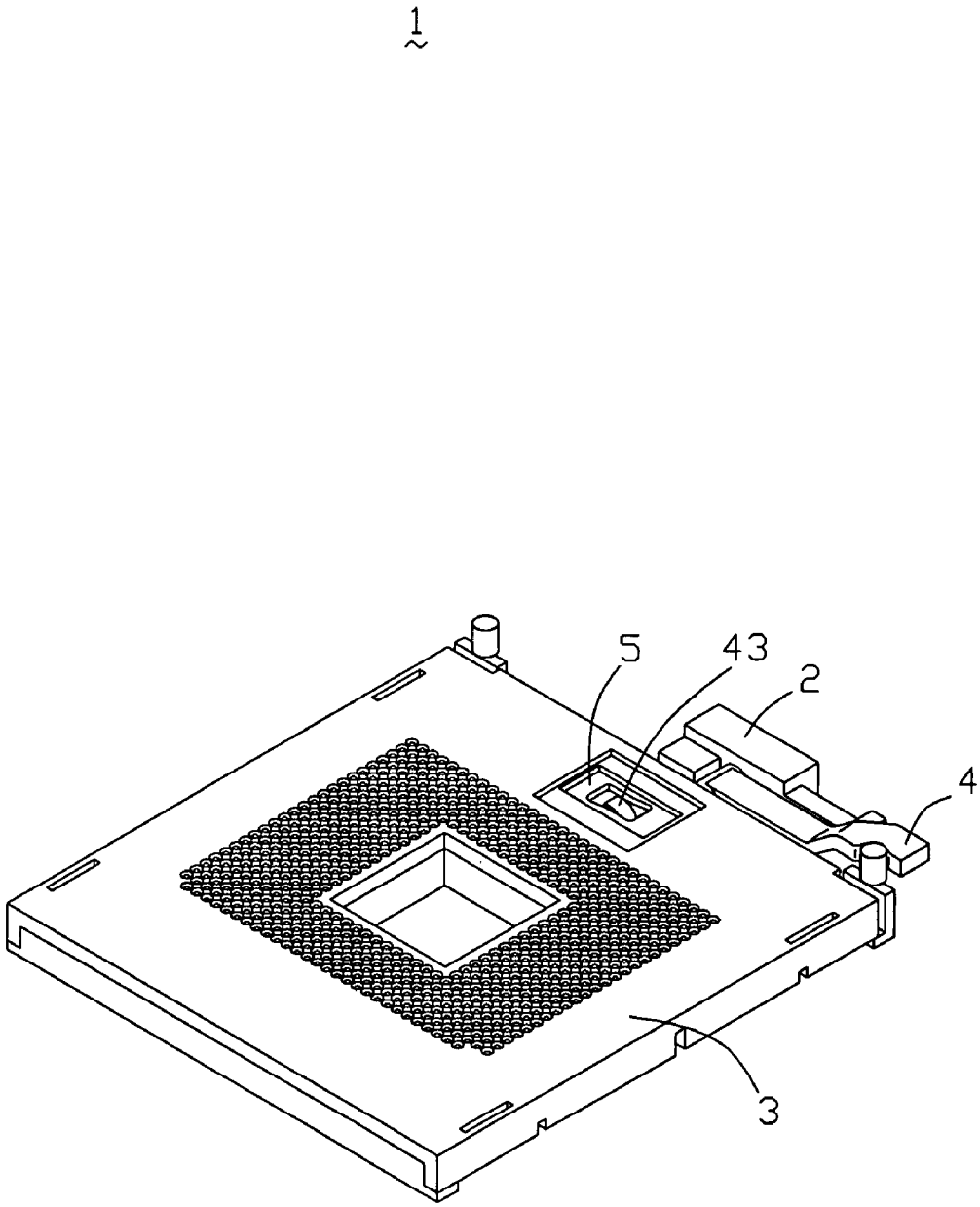
FIG. 7 is an assembled view of FIG. 1.

Referring to FIG. 5, the metal reinforced device 6 of the third embodiment of the present invention is shown. The cover 3 and the base 2 are similar to the first embodiment except the sector 21 of base 2 and the main plate 31 of the cover 3 did not divided into several sections.

Referring to FIG. 5, the metal reinforced device 6 of the third embodiment of the present invention is shown. The cover 3 and the base 2 are similar to the third embodiment and the frame 62 of metal reinforced device 6 is covered the surrounding portion 22 and the top portion 23 of the base 2 respectively.

As can be seen from FIGS. 1-7, the metal reinforced device 6 covers the base 2. When the rotation of the actuation mechanism 4, the metal reinforced device 6 sustain greater forces exert on the base 2 and the cover 3, the base 2 is still able to withstand the forces thereat. The base 2 and cover 3 are resistant to deformation and maintain the effective displacement of the cover respect to the base, and the electrical connector socket can provide reliable electrical connection between the CPU and the PCB.

It be noted that the metal reinforced device can be covered onto the cover also. The metal reinforced device is similar to the first embodiment or the second embodiment and the main plate of cover is divided into several sections.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector socket, comprising:

an insulating base comprising a plurality of passageways, each passageway assembled with a contact terminal;

wherein the plurality of passageways are arranged in a sector, the sector is divided into several sections that each sector has at least one set of edge to form at least one channel thereon, and a cover moveably mounted on the base;

an actuation mechanism arranged between the base and the cover so as to move the cover along a top surface of the base; and a metal reinforced device stamped and formed from a sheet of metallic material, the metal reinforced device defines a bridge portion corresponding to the channel of the base; the metal reinforced device attached to the top surface of the base to sustain greater forces exerting on the base during a rotation of the actuation mechanism.

2. The electrical connector socket as claimed in claim 1, wherein the base has a surrounding portion surrounding the sector thereof, the metal reinforced device has a frame covering the surrounding portion of the base and surrounding the passageways of the base.

3. The electrical connector socket as claimed in claim 2, wherein the base further defines a top portion extending from the surrounding portion thereof, and the frame of the metal reinforced device is also covered onto the top portion of base.

4. The electrical connector socket as claimed in claim 1, wherein the base further defines a rectangular opening in a center thereof, and the metal reinforced device has a groove corresponding to the opening of the base.

5. The electrical connector as socket claimed in claim 4, wherein the bridge portion of metal reinforced device is connected to the groove and the frame.

6. An electrical connector socket, comprising:

an insulating base comprising a plurality of passageways arranged in sector across a top surface of the base and spaced from one another, each passageway assembled with a contact terminal;

a cover mounted on the base and comprising a main plate defining a plurality of through holes corresponding to the passageways of the base, a peripheral portion surrounding the main plate, and a head portion extending from one side of the main plate;

a metal reinforced device attached to a bottom surface of the peripheral portion of the cover to sustain greater forces exerting on the cover, the metal reinforced device comprising a rectangular frame covering the peripheral portion of cover and surrounding the through holes of the cover; and an actuation mechanism is sandwiched between the base and the cover.

7. The electrical connector socket as claimed in claim 6, wherein the cover is divided into several sections that each has at least one set of edge to form at least one channel thereon, and the metal reinforced device defines a bridge portion corresponding to the channel of cover.

8. The electrical connector socket as claimed in claim 7, wherein the frame of the metal reinforced device covers the head portion of the cover.

9. The electrical connector socket as claimed in claim 6, wherein the cover further defines a rectangular slit in a center thereof, and the metal reinforced device has a groove corresponding to the slit of the cover.

10. The electrical connector socket as claimed in claim 6, wherein the actuation comprises a driving shaft with a lever arm linked perpendicular to an end thereof.

11. The electrical connector socket as claimed in claim 10, wherein the top portion of base providing with a shaft seat in which the driving shaft can be rotationally seated therein.

12. A socket connector comprising:

an insulative base defining a plurality of passageways therein, said base defining first exterior width thereof;

a plurality of contacts disposed in the corresponding passageways, respectively;

an insulative cover defining therein a plurality of through holes in alignment with the corresponding passageways, respectively, said cover defining a second exterior width thereof; and a metallic reinforcement device sandwiched between said base and said cover for absorbing forces imposed upon either the cover or the base, said reinforcement device defines a third exterior width; wherein all said first exterior width, said second exterior width and said third exterior width are similar; wherein said reinforced device is substantially circumferentially hidden within a contour of said cover.

13. The electrical connector socket as claimed in claim 1, wherein said passageways define a contact area in a top view, and the metal reinforced device surrounds said contact area.

* * * * *